United States Patent [19]

Russell

[11] Patent Number: 4,966,173

[45] Date of Patent: Oct. 30, 1990

[54] HAIRPIECE FOR COMPENSATION OF HAIR LOSS

[76] Inventor: Della L. Russell, 1995 N. 2000 West, Ogden, Utah 84404

[21] Appl. No.: 400,477

[22] Filed: Aug. 30, 1989

[51] Int. Cl.[5] ..... A41G 5/00

[52] U.S. Cl. ..... 132/54; 132/53

[58] Field of Search ..... 132/201, 53, 54, 55, 132/56

[56] References Cited

U.S. PATENT DOCUMENTS

| | | | |
|---|---|---|---|
| D. 205,576 | 8/1966 | Day | 132/54 |
| 1,526,440 | 2/1925 | Skaruda | 132/54 |
| 1,558,931 | 10/1925 | Senegas | 132/54 |
| 3,435,832 | 4/1969 | Ito | 132/54 |
| 4,819,671 | 4/1989 | Walker | 132/54 |

FOREIGN PATENT DOCUMENTS

| | | | |
|---|---|---|---|
| 600770 | 11/1925 | France | 132/54 |

*Primary Examiner*—John J. Wilson
*Assistant Examiner*—Michael Lynch
*Attorney, Agent, or Firm*—Trask, Britt & Rossa

[57] ABSTRACT

A hairpiece for covering areas of partial hair loss, removal or thinning on a user's head is disclosed. The hairpiece includes a band of resilient material in an arcuate shape which conforms to the user's head and biases thereagainst, and a foundation member to which hair is attached. When worn, the foundation of hair is positioned over the area of hair loss or removal to conceal the area, and the user's own hair may be combed or styled in a fashion to incorporate the hair of the hairpiece with that of the user to produce a natural look.

8 Claims, 2 Drawing Sheets

HAIRPIECE FOR COMPENSATION OF HAIR LOSS

BACKGROUND OF THE INVENTION

1. Field of the Invention

This invention relates to hairpieces which are typically worn to enhance the wearer's appearance and to compensate for deficiencies of hair on the wearer's head.

2. State of the Art

A number of hairpieces have been disclosed most of which have been directed to supplementing the length or thickness of the wearer's own hair. Such devices are disclosed in U.S. Pat. No. 1,634,190 (Hepner), U.S. Pat. No. 3,434,481 (Mazzocco), and U.S. Pat. No. 4,600,029 (Ueberschaar). In contrast, some hairpieces have been designed to give the wearer the appearance of having shorter hair. One such hairpiece is disclosed in U.S. Pat. No. 1,346,718 (Muller).

Further, hairpieces have been disclosed which essentially include a band or bands of hair to connect to the wearer's entire head, or to connect to certain portions of the head. Such devices are disclosed in U.S. Pat. No. 3,628,546 (Ensminger), which discloses a single band of hair, and U.S. Pat. No. 3,435,832 (Ito), which discloses a series of bands intended to generally cover the entire head. French Patent No. 701,974 also discloses a modified band of hair for enhancing the wearer's own hair which can also be used as a tiara for insertion of flowers and the like.

The prior art has generally been concerned with enhancing the wearer's own hair and has not been specifically directed toward covering areas of the wearer's head where, because of a natural deficiency of hair, natural hair loss, or preoperative hair removal, there is a patch or strip of permanent or temporary baldness. For example, with advancements in surgical techniques, many types of brain surgeries can now be performed without having to shave the patient's entire head. Frequently, surgery can be performed by means of a relatively small incision in the scalp. This procedure requires the shaving of only a small area or strip of hair on a patient's head. While the patient's head may have been shaved to an extent that it is impossible to comb the remaining hair over the shaved area, oftentimes the patient has not been shaved sufficiently to require his wearing a wig or hairpiece which covers the entire head. Recognizably, the patient's desire to cover the area of hair loss is important for many reasons, both personal and otherwise. This desire is oftentimes most pronounced in persons with very short hair.

It would be advantageous therefore to provide an apparatus for covering areas of permanent or temporary hair loss which at once provides a means of attractively covering isolated hair loss areas, thereby avoiding any need for wearing a full wig or hairpiece to cover those areas.

SUMMARY OF THE INVENTION

This invention is designed for persons who have had a temporary or permanent loss of hair in isolated areas of the head and who require means for hiding the hair loss area. The invention includes a frame member and quantity of hair applied thereto, which together form a hairpiece. The frame member may be generally arcuate in shape being adapted to fit about the wearer's head. The frame member may preferably be made of a resilient material which, when the frame is placed about the wearer's head, causes the frame to be biased against the wearer's head. This biasing action retains the frame in place about the wearer's head. The frame may further be made of a sturdy, yet lightweight material.

The frame may be covered directly with a quantity of hair or, alternatively, a foundation member may be mounted on the frame. In this alternative construction, the hair is attached to the foundation member. In either embodiment, the hair may be applied along the entire length of the frame member or foundation member. Alternatively, in situations where there is a small area of hair loss or removal on the wearer's head, the hair may be selectively applied along a partial length of the frame or foundation. The hair is positioned on the frame such that the hair will register with or be positioned over and atop the area of hair loss or removal on the wearer's head, when the frame is positioned on the wearer's head.

The frame member or foundation member may be of any suitable material to which hair may be permanently attached. In applications where the user has been shaved prior to surgery, and where postoperative stitches may remain in the scalp, it is desirable that the hairpiece be of a type which will not cause irritation of the sensitive surgical incision site. It is also important that the hairpiece be air-permeable, thereby allowing adequate circulation to the site to be covered. Various constructions are seen as meeting those requirements. For example, the band may be formed as a grid-like structure which defines a plurality of apertures therein. In those embodiments which include a foundation member, that foundation may be formed of materials such as cotton, linen, or a breathable synthetic material.

The hair which is placed upon the frame member or foundation member is generally selected to match the hair color and hair length of the intended wearer so that the wearer's own hair may be combed into the hair of the hairpiece to produce a natural appearance. In those embodiments wherein the hair extends only partially along the length of the frame, i.e., in those constructions adapted to cover a small area of hair loss, the wearer's own hair may be combed over that portion of the frame member which is not covered with hair to hide the frame. The wearer's hair which surrounds the area of hair loss is combed into the hair on the frame to produce a natural appearance.

In a preferred embodiment, the frame of the invention is held in place on the wearer's head by virtue of its arcuate shape and the resiliency of material making up the frame. This allows the hairpiece to conform to the wearer's head and to be retained in place by the biasing action of the band. In an alternative embodiment, separate fasteners, such as bobby pins, may be used by the wearer to secure the invention in place by interconnecting those fasteners with his or her own hair. This fastener feature may be separate from the hairpiece itself or it may be integral with the hairpiece. In some constructions, the fasteners may be used in conjunction with a resilient bias-producing band. Alternatively, the fasteners may be the sole means to retain the hairpiece in place.

DETAILED DESCRIPTION OF THE ILLUSTRATED EMBODIMENTS

The hairpiece of the invention generally includes a frame, generally 10, having a quantity of hair, generally 20, attached thereto. The hairpiece is positionable on a wearer's head to hide an area of hair loss or removal.

The Frame

Figure 1:
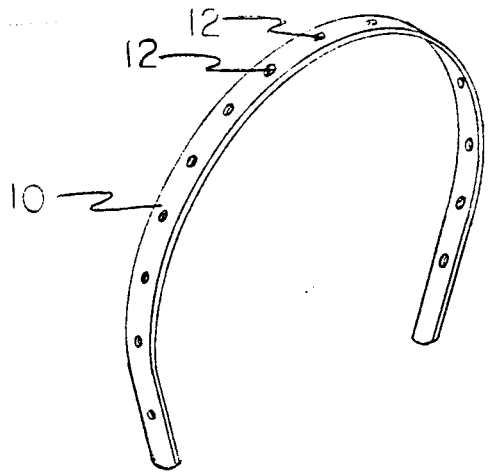
FIG. 1 is a perspective view of a band-like frame of the invention.

The frame 10 of the invention is illustrated in FIG. 1 as a band-like structure. The frame is arcuately shaped to correspond generally with the shape of the wearer's head and is fabricated of a resilient and flexible material. Due to the resiliency of the frame material, and the arcuate shape of that frame, the wearer may spread the free ends 11 of the frame outwardly from each other sufficiently to position the frame 10 about the wearer's head. Upon releasing those ends 11, the same resiliency cause the frame 10 to return to its arcuate shape in a biased relationship about the wearer's head. The frame 10 is configured to be sufficiently biased against the wearer's head to retain itself securely in place.

In one embodiment of the invention, a quantity of hair 20 may be attached directly to the frame 10. As shown to advantage in FIG. 1, a plurality of apertures 12 are formed within the frame 10 along a length thereof to provide means by which the hair may be attached to the frame. Such attachment may be by knotting, weaving, or similar tying through the apertures. Alternatively, the hair may be mounted by means of adhesives.

The Foundation

Figure 2:
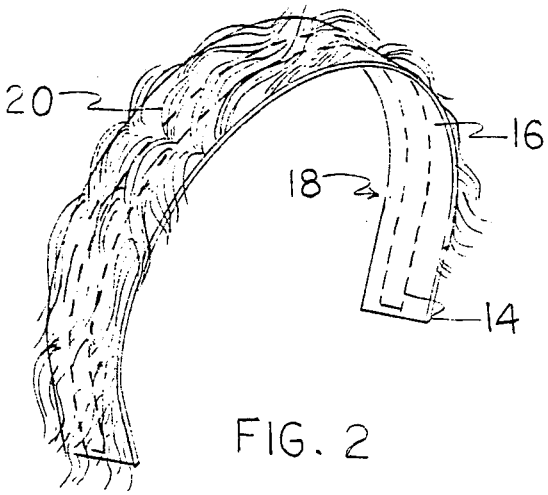
FIG. 2 is a perspective view of a band-like frame having a foundation member to which hair has been mounted, the foundation member is shown extending along the entire length of the frame.

In an alternative embodiment shown in FIG. 2, a foundation member 16, to which hair 20 has been mounted, may be attached to the frame 14. The frame 14 acts as a structural support for the foundation member. In this embodiment, the apertures 12, illustrated in FIG. 1, facilitate the securement of the foundation 16 to the frame. For example, the apertures 12 allow the foundation to be sewn to the frame 14 by means of thread stitches taken through the apertures 12. The number of apertures 12 formed in the frame 14 are generally limited to that number necessary to secure the foundation 16 to the frame; for example, if the foundation 16 is substantially shorter in length than that of the frame 14 (see FIG. 3), the number of apertures formed in the frame would be less than the number of apertures required to attach a foundation 16 which extends along the complete length of the frame (see FIG. 2).

The foundation member 16 may preferably be fabricated from any material which is sufficiently flexible for allowing the positioning of the foundation member about the wearer's head. The foundation 16 should also be fabricated from materials which allow circulation of air in and around the wearer's scalp and facilitates mounting of hair thereupon. Such materials may include natural fiber fabrics such as cotton, linen, or synthetic fabrics, or any other material having suitably similar characteristics.

The foundation member 16 may take any form which facilitates secure attachment to the frame member 10. The foundation member 16 may be attached to the frame 10 in any manner which provides securement of the foundation 16 to the frame 10. Possible conformations of the foundation member and modes of attachment include a single ply of fabric forming the foundation member 16, the foundation member being attached to the outer face of the frame. In an alternative embodiment, the foundation may have two plies conjoined together along their longitudinal edges. One ply is positioned on the outer face of the frame member 10 and the other ply is positioned on the inner face of the frame member 10, as illustrated in FIG. 2 at 18. The ply on the inner face of the frame member 10 presents a smooth, uninterrupted surface which acts as an interface between the hairpiece and the user's scalp. The embodiment illustrated in FIG. 2 provides enhanced protection to the sensitive scalp of a postoperative patient. The ply of the foundation 16, positionable atop the wearer's scalp, due to its fabrication, is a material having characteristics which include softness, flexibility, and "breathability," or the ability to allow circulation of air through the material to the wearer's scalp.

The length or shape of the foundation member may be dictated by the size or shape of the area of the head to be covered. FIG. 2 illustrates an embodiment of the invention where the foundation 16 is generally a rectangular member substantially equal in length to that of the frame 10. The embodiment of FIG. 2 would be appropriate, for example, for patients who have had surgery requiring an incision along the upper crown of the head.

Figure 3:
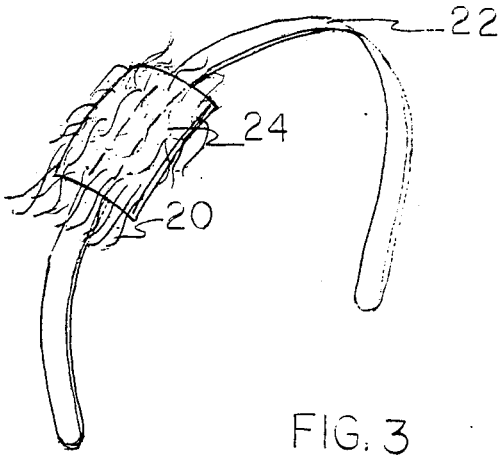
FIG. 3 is a perspective view of an alternative embodiment of the invention in which a foundation member, to which hair has been mounted, extends only partially along the full length of the frame.

In an alternative embodiment, the foundation 24 may be substantially shorter in length relative to the frame 22. This embodiment is illustrated in FIG. 3. In this construction, the foundation 24 may be positioned anywhere along the length of the frame 10 so as to register with the area of hair loss upon the placement of the hairpiece on the wearer's head. Application of the embodiment of FIG. 3 would be appropriate, for example, where the wearer has only a small area of hair loss, hair removal, or thinning which cannot be readily concealed by combing the wearer's own hair over the area. The positioning of the foundation 24 relative to the frame, and the positioning of the frame on the wearer's head is calculated, therefore, to coincide with the area of hair loss or removal which is to be concealed. The foundation may be configured or shaped to correspond with the shape of the area of hair loss, removal, or thinning on the wearer's head. For example, the foundation member may be shaped as a circle, rectangle, crescent, or any irregular shape.

Figure 4:
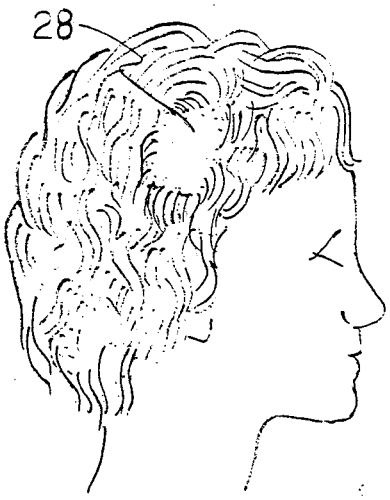
FIG. 4 is a side view of a person having partial hair loss in an isolated area of her head.
Figure 5:
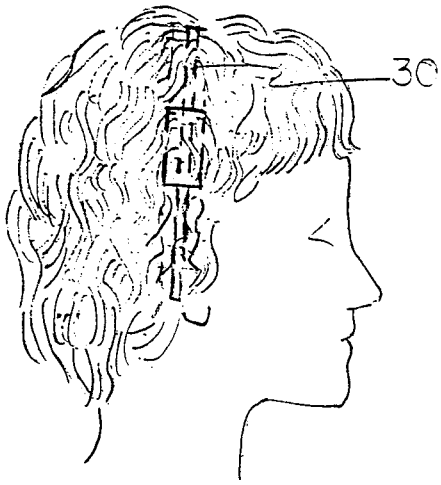
FIG. 5 is a side view of the person shown in FIG. 4 illustrating the person wearing the invention to cover the area of hair loss.

FIGS. 4 and 5 illustrate the application of the embodiment shown in FIG. 3. In FIG. 4 a person is shown having a small area of hair 28 missing on the side of his or her head. In FIG. 5, the person is shown having the frame 30, in phantom, positioned on his or her head to coincide with the area of hair loss. As particularly illustrated, the hair of the wearer may be combed or styled to incorporate the hair mounted on the foundation into the wearer's own hair to produce a natural appearance.

Further, the wearer's own hair is combed or styled to conceal the frame of the invention which rests against the scalp of the wearer.

Figure 6:
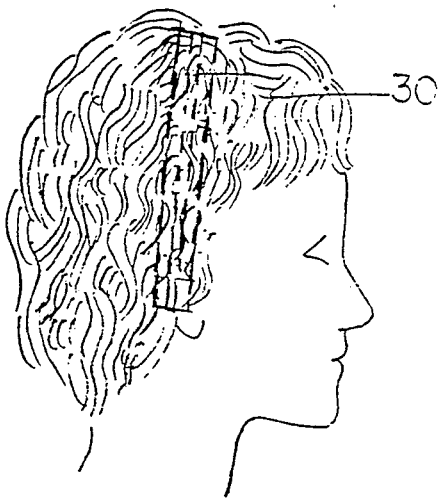
FIG. 6 is a side view of a person wearing the hairpiece of FIG. 2.

Similarly, FIG. 6 illustrates the placement of a hairpiece of the embodiment of FIG. 2 about the head of a wearer.

Securement of the foundation to the area of hair loss or removal on the wearer's head, particularly in cases where the area is irregular in shape, may be enhanced by judicious application of an adhesive substance, such as commercial wig adhesive, around the edges of the foundation to cause the foundation to adhere to the scalp. Securement of the foundation and frame to the wearer's head may also be supplemented by the use of hairpins or clips to attach the frame 10 or foundation to the wearer's natural hair. The invention also may be constructed with fasteners mechanically associated with the frame or foundation to aid in attachment to the wearer's hair.

The Hair

Hair 20 is mounted to the foundation 16 so that the hair projects above and outwardly from the foundation. The hair may be applied to the foundation in any number of ways, including sewing, weaving, or adhering by means of an adhesive substance, e.g., glue. The hair 20 which is mounted to the foundation or frame may be chosen to generally match the color and length of the wearer's own hair, but a wearer may choose a color or length which may enhance his or her own hair when the hair of the invention is incorporated into that of the wearer.

The embodiments described herein are illustrative of the invention and are not meant to limit the scope of the invention which is defined by the claims appended hereto.

I claim:

1. A hairpiece consisting of:

a frame member for placement on a user's head, said frame member being fabricated from a resilient material and having an inverted "U" shaped configuration shaped to conform to and bias against said user's head; said frame member having a length, an inner surface and an outer surface;

a foundation member attached to said frame; said foundation member consisting of:

a first ply of fabric having at least one longitudinal edge, said first ply of fabric ply of fabric being positioned on said frame member's inner surface to extend along a selected length of said inner surface, said first ply of fabric forming a smooth uninterrupted surface, said first ply of fabric being fabricated from a material which is soft and nonabrasive to sensitive skin; and a second ply of fabric having at least one longitudinal edge, said second ply of fabric having positioned on said frame member's outer surface to extend along said selected length of said outer surface, said second ply of fabric being positioned to align its said longitudinal edge with said longitudinal edge of said first ply of fabric, said second ply of fabric being joined to said first ply of fabric by stitching said longitudinal edges together;

said foundation member being positioned on said frame member to register with an area of hair loss on said user's head when said frame member is placed on said user's head for concealment of said area of hair loss; and hair attached to said foundation member.

2. The hairpiece of claim 1 wherein said foundation member extends substantially along the entire length of said frame.

3. The hairpiece of claim 1 wherein said foundation member extends only partially along said length of said frame member and said foundation member is located along said frame member in a position corresponding to an area of hair loss, removal, or thinning on said user's head, for concealment thereof.

4. The hairpiece of claim 1 wherein said first ply of fabric is fabricated from an air-porous material.

5. The hairpiece of claim 1 wherein said frame member has a plurality of apertures formed therein along said length to facilitate securement of said foundation member to said frame member at any of a plurality of locations along said frame member's length.

6. The hairpiece of claim 1 further comprising at least one fastener member mechanically associated with said frame member for securement of said hairpiece to said user's own hair.

7. The hairpiece of claim 1 wherein said apertures are formed in only a partial length of said frame member's length for facilitating attachment of said foundation member to a specific location along said frame member in a position which corresponds to an area of hair loss, removal or thinning for concealment thereof.

8. A hairpiece consisting of:

a frame member for placement on a user's head, said frame member being fabricated from a resilient material and having an inverted "U"-shape configuration shaped to conform to and bias against said user's head, said frame member having a length, an inner surface and an outer surface;

a foundation member attached to said frame member, said foundation member consisting of:

a first ply of fabric, configured in a rectangular shape and having a pair of opposing longitudinal edges, said first ply of fabric being positioned on said frame's inner surface to extend longitudinally along a selected length of that inner surface; said first ply of fabric forming a smooth, uninterrupted surface; said first ply of fabric being fabricated of a material which is soft and non-abrasive to sensitive skin;

a second ply of fabric, configured in a rectangular shape and having a pair of opposing longitudinal edges, said second ply of fabric being positioned on said frame's outer surface and extending along said selected length of said outer surface; each longitudinal edge of said second ply being positioned atop a respective longitudinal edge of said first ply to form two pair of longitudinal edges, said first ply of fabric and said second ply of fabric being joined one to another by stitching each pair of longitudinal edges together, said foundation member extending only partially along said length of said frame member and being so positioned upon said frame member to register with an area of hair loss, removal or thinning on said user's head for concealment thereof; and hair attached to said foundation member.

* * * * *

UNITED STATES PATENT AND TRADEMARK OFFICE

CERTIFICATE OF CORRECTION

PATENT NO. : 4,966,173

DATED : October 30, 1990

INVENTOR(S) : Della L. Russell

It is certified that error appears in the above-indentified patent and that said Letters Patent is hereby corrected as shown below:

Column 5, line 56, change "having" to --being--.

Column 6. line 12, delete ",".

Signed and Sealed this

First Day of March, 1994

Bruce Lehman

*Attest:*

BRUCE LEHMAN

*Attesting Officer*

*Commissioner of Patents and Trademarks*